United States Patent [19]

Steinhardt et al.

[11] Patent Number: 5,035,661

[45] Date of Patent: Jul. 30, 1991

[54] FLAT-CONTACT RECEPTACLE

[75] Inventors: Helmut Steinhardt, Dürnberg; Anton Bieringer, Schwabach, both of Fed. Rep. of Germany

[73] Assignee: TRW Daut+Rietz GmbH & Co., Nuremberg, Fed. Rep. of Germany

[21] Appl. No.: 469,585

[22] PCT Filed: Jul. 13, 1989

[86] PCT No.: PCT/EP89/00813

§ 371 Date: Apr. 25, 1990

§ 102(e) Date: Apr. 25, 1990

[87] PCT Pub. No.: WO90/01815

PCT Pub. Date: Feb. 22, 1990

[30] Foreign Application Priority Data

Aug. 5, 1988 [DE] Fed. Rep. of Germany ..... 3826670

[51] Int. Cl.[5] ..... H01R 4/48

[52] U.S. Cl. ..... 439/839; 439/595

[58] Field of Search ..... 439/833, 839, 849, 850, 439/851, 856, 857, 595, 599, 600

[56] References Cited

U.S. PATENT DOCUMENTS 4,040,713 8/1927 Konnemann ..... 439/839
4,540,235 9/1985 Lolic ..... 439/839
4,583,812 4/1986 Gross, Jr. et al. ..... 439/839

FOREIGN PATENT DOCUMENTS 3231484 3/1983 Fed. Rep. of Germany ..... 439/850
8903129 4/1989 PCT Int'l Appl. ..... 439/839
832970 4/1960 United Kingdom ..... 439/839

*Primary Examiner*—David L. Pirlot
*Attorney, Agent, or Firm*—Collard, Roe & Galgano

[57] ABSTRACT

A flat-pin receptacle comprises two contact tabs arranged on the receptacle body and resiliently in contact with each other along part of their length. A connecting spring surrounding the receptacle body presses against the outside of each contact tab along two strip-shaped sections on the connecting spring body arranged at a distance apart. The receptacle body has recesses for receiving locking tongues which are arranged on, and can be bent away from, the receptacle housing. To facilitate assembly of the locking tongues in receptacle housings, a strip part (14) is arranged on both sides of the connecting spring (12) between the sections (13) and parallel to the latter. The strip parts (14) are bent back towards each other and inward over the free ends of the contact tabs (6) along part of their length opposite the connecting spring body (12').

5 Claims, 4 Drawing Sheets

FLAT-CONTACT RECEPTACLE

DESCRIPTION

Flat-Contact Receptacle

Figure 1:
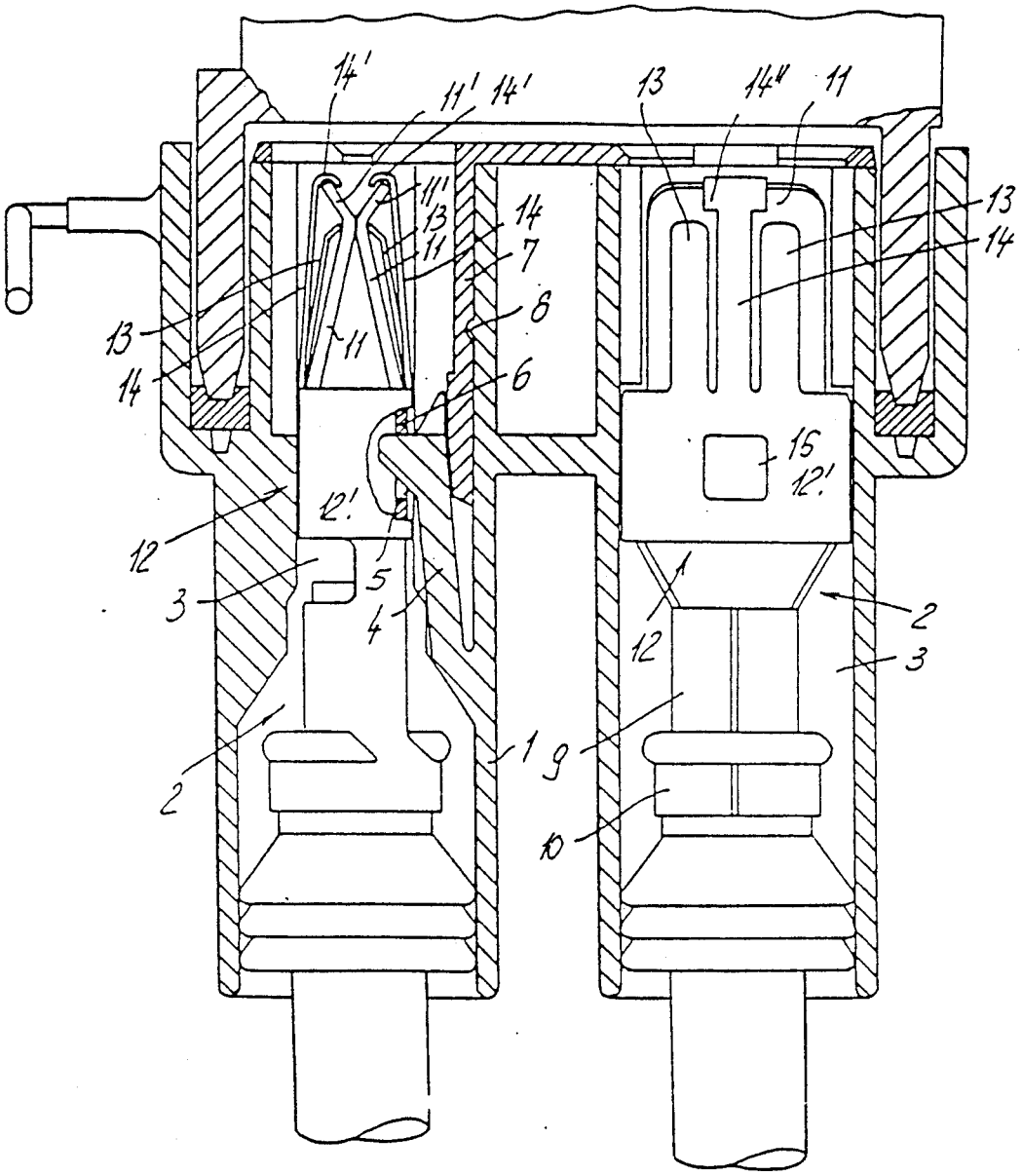

The invention concerns a flat-contact receptacle having two contact tabs attached to the receptacle body which are elastically pressed against each other over part of their length under a spring load, as well as an envelope spring encompassing the receptacle body which presses against the outer surfaces of the contact tabs with two strip-shaped sections each, situated at some distance next to each other on the body of the envelope spring, the receptacle body being fitted with recesses for receiving flexible latches located on the receptacle housing.

It is a known procedure to insert flat-contact receptacle into openings of receptacle housings from one end and to lock the flat-contact receptacles in the openings. In the process of inserting the flat-contact receptacles, the problem often occurs that the free ends of the contact tabs, which are bent back toward the outside, get entangled with receptacle housing surfaces, which has a negative influence on the insertion process, particularly when the insertion is done mechanically. An additional aggravating factor in flat-contact receptacles with envelope springs is that the strip-shaped sections of the envelope springs which press against the contact tabs can cause additional entanglements during the insertion process.

It is the purpose of this invention to design means for inserting flat-contact receptacles into receptacle housings without impediments, and to render the automatic assembly of flat-contact receptacles trouble-free.

According to the invention, this purpose is achieved by placing a strap between and in parallel with the strip-shaped sections on either side of the envelope spring body, the portion of the straps facing away from the envelope spring body (12') being bent over the free ends of the contact tabs (6) toward each other and inward. In this manner, unbroken guide surfaces are formed on both of the flat sides of the flat-contact receptacle between the receptacle body and the ends of the contact tabs, which allow the flat-contact receptacle to slide alongside housing surfaces and prevent entanglements. According to a preferred form of construction, the body of the envelope spring, the strip-shaped sections and the straps are cut in one piece from flat sheet metal.

By way of further detailing of the flat-contact receptacle, the envelope spring body and the receptacle body will be rigidly attached to each other by bending retaining flaps on the envelope spring body inward and/or backward over edges of recesses provided in the receptacle body. As a result of the bending action of the envelope spring body, the latter is wedged to the receptacle body. Also, it is possible to rigidly attach the envelope spring body to the receptacle body in any other desired manner, particularly by welding, e.g. by means of a laser. Moreover, the design provides for the envelope spring to have openings of equal shape and size and lying in the same axis as the openings of the receptacle body, through which the latches attached to the receptacle housing can pass.

The envelope spring is produced in a simple manner by carrying out the following operations: The envelope spring body is cut from a piece of flat sheet metal together with the straps and the strip-shaped sections, leaving a bridge; the envelope spring body, the strip-shaped sections and the straps are then folded or bent; the transport strip is wound into a coil; for assembly, the envelope spring is separated from the transport strip in the area of the bridge. Having a transport strip helps to automate the production process of the flat-contact receptacle and facilitates the production and assembly of the envelope spring.

Figure 3:
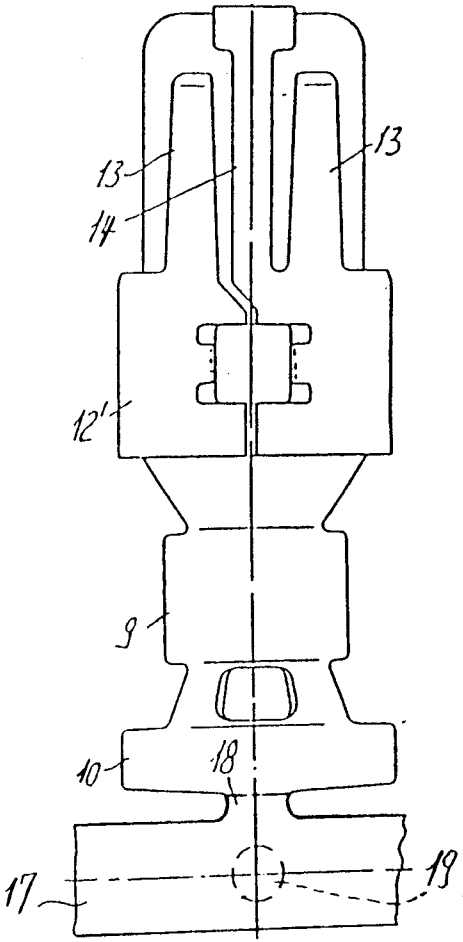
Figure 2:
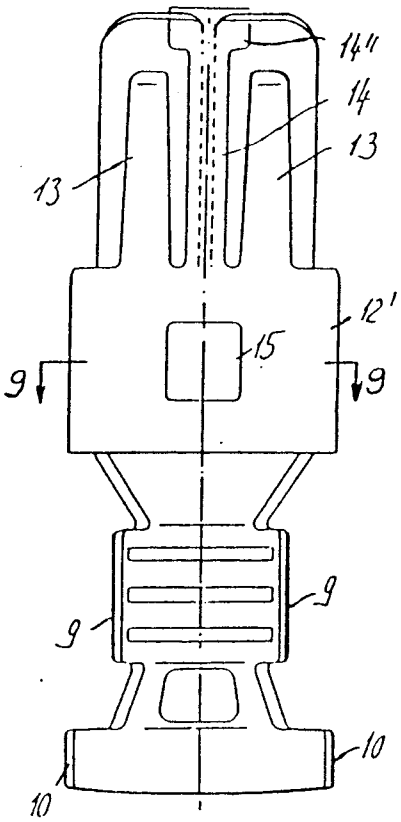
Figure 4:
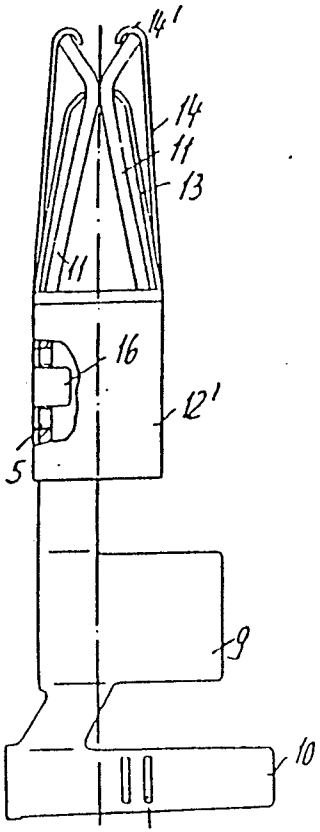
Figure 7:
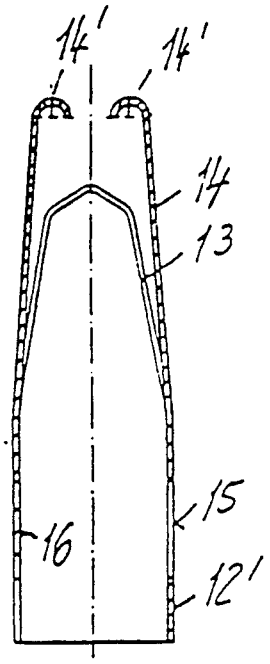
Figure 5:
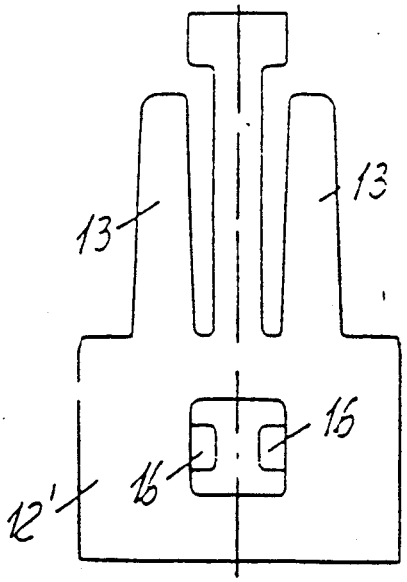
Figure 6:
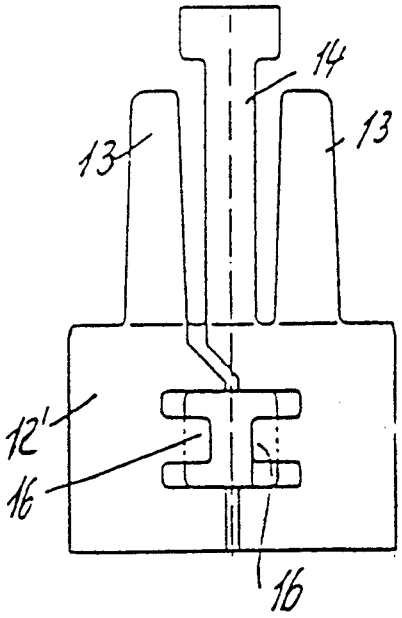
Figure 9:
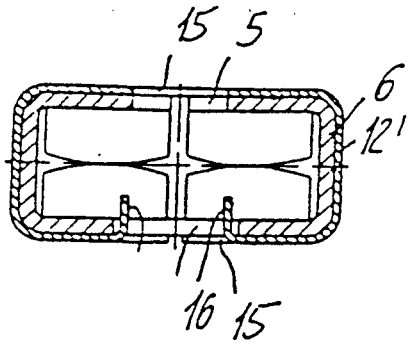
Figure 8:
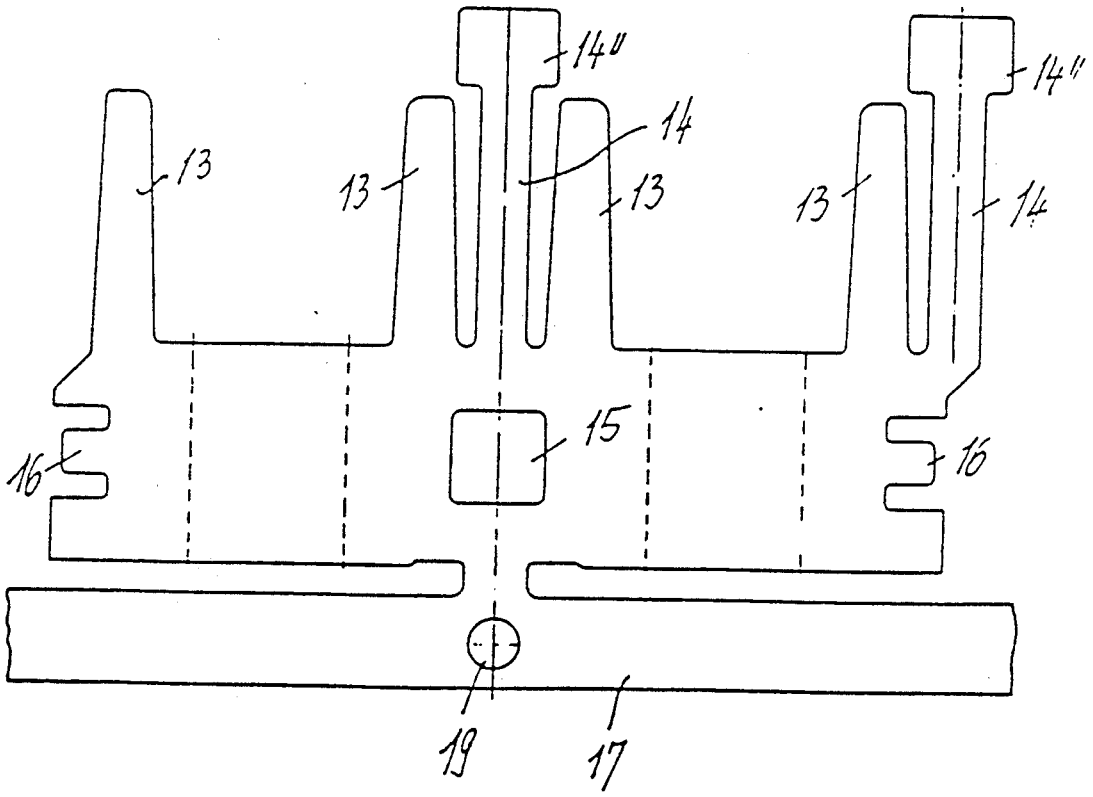

The invention is made clear by the drawing showing an implemented example. The drawing includes:

FIG. 1 a cross-sectional view of a flat-contact receptacle with a receptacle housing, FIG. 2 a front view of a flat-contact receptacle, FIG. 3 a rear view of a flat-contact receptacle, including a transport strip, FIG. 4 a side view of a flat-contact receptacle, FIG. 5 a front view of an envelope spring, FIG. 6 a rear view of an envelope spring, FIG. 7 a cross-sectional view of an envelope spring, FIG. 8 an envelope spring as a flat cut-out with a transport strip, and FIG. 9 a cross-section along the line IX—IX of FIG. 3.

Position 1 in the Figures identifies a receptacle housing for receiving flat contact receptacles 2. The flat-contact receptacles 2 are inserted into openings 3 of the receptacle housing 1 from one end and are held in place by a flexible locking element 4. In the example, a latch flexibly attached to the housing is used for a locking element 4. The pre tensioned latch 4 engages with an opening 5 of the receptacle body 6 and is fixed in the engaged position by a slide 7 which is pushed into the receptacle housing 1. The slide 7 is fixed by means of a click stop 8 in the receptacle housing 1.

As FIGS. 1 through 4 show, the flat-contact recpetacles 2 have a receptacle body 6 which at one end extends into crimping sockets 9 and 10 for fastening electrical conductors or the insulotion. As can also be seen, the receptacle body carries contact tabs 11 whose free ends 11' are bent back outward in order to form angled plug-in surfaces for contact blades (not shown). The receptacle body 6 carries an envelope spring 12 formed of an envelope spring body 12' with adjoining strip-shaped sections 13. The sections 13 are pre tensioned with respect to each other and lie against the contact tabs 11 from the outside in order to support the contact force. Further, a strap 14 is provided on the envelope spring body 12' between the strip-shaped sections 13 on both sides which is essentially parallel with the sections 13 and reaches over the appropriate end of the contact tab with its free end 14' and is bent back inward. It is useful to fit the ends of the straps 14 with wider sections 14''.

The envelope spring 12 is attached by wedging the envelope spring body 12' to the receptacle body and carries recesses 15 on opposing sides, located on the same axis as the recesses 5 of the receptacle body 6, to receive the spring-loaded latches 4.

As FIG. 1 shows, the straps 14 form flat insertion surfaces between the free ends of the contact tabs 11 and the receptacle body 6 so that the flat-contact receptacle can be reliably and freely inserted into openings 3 of a receptacle housing 1. The invention also covers a design in which several straps 14 can be provided on an envelope spring body 12'. It is thus possible to form one strap 14 each on both sides of a single strip-shaped section 13. In order to lock the envelope spring 12 to the receptacle body 6, the envelope spring 12 has flaps 16 in the area of an opening 15, as shown in FIGS. 5 and 6, which attach the envelope spring 12 to the receptacle body 6 by being bent into the opening 5 of the receptacle body 6 after placing the envelope spring 12 onto the recpetacle body 6 (FIG. 9).

For manufacturing the envelope spring, it is proposed that the envelope spring body 12', the strip-shaped sections 13 and the straps 14 be cut from a flat, pre-formed sheet-metal part together with a transport strip 17, with the envelope spring body 12' remaining attached to the transport strip 17 through a bridge 18. The transport strip 17 carries openings 19 whose distance from each other is determined by the dimensions of the envelope spring 12.

To place the envelope spring 12 onto the receptacle body 6, the envelope spring 12 is separated from the transport strip 17 in the area of the bridge 18 (FIG. 3), pushed over the receptacle body and fastened in place by bending the flaps 16 inward.

What is claimed is:

1. A flat-contact receptacle comprising:

a receptacle body having at least one recess for receiving a flexible latch located on a receptacle housing, two contact tabs, each of which has a free end and a fixed end attached to said receptacle body and which are resiliently pressed against each other over part of their length under a spring load; and an envelope spring having a spring body supported on and surrounding said receptacle body, two paired sets of spaced-apart strip-shaped sections mounted on said spring body, one of said paired sets of spaced-apart strip-shaped sections being disposed to press against the outer surfaces of one of said tabs, and the other of said paired sets being disposed to press against the outer surfaces of the other of said tabs so as to define said spring load, and a pair of straps, each of which is mounted on opposite sides of said spring body with one of said straps disposed between and generally parallel to said one paired set of spaced-apart strip-shaped sections and the other of said straps being disposed between and generally parallel to said other paired set of spaced-apart strip-shaped sections, said straps each being associated with one of said contact tabs and each having a free end portion which is bent inwardly and backwardly to fit over the free end of the associated contact tab.

2. The flat-contact receptacle, as claimed in claim 1, wherein said spring body, said strip-shaped sections and said straps are made in one piece from flat sheet metal.

3. The flat-contact receptacle, as claimed in claim 1, wherein said body has a retaining flap and wherein said spring body and said receptacle body are rigidly attached to each other by bending said retaining flap spring body through said recesses in the receptacle body.

4. The flat-contact receptacle, as claimed in claim 1, wherein said spring body and said receptacle body are rigidly attached to each other by welding.

5. The flat-contact receptacle, as claimed in claim 1, wherein the spring body and said receptacle body each have an aperture which are approximately the same size and shape which are generally coaxially disposed so as to be able to receive said latch jointly.

* * * * *

UNITED STATES PATENT AND TRADEMARK OFFICE

CERTIFICATE OF CORRECTION

PATENT NO. : 5,035,661

DATED : July 30, 1991

INVENTOR(S) : Helmut Steinhardt et al

It is certified that error appears in the above-identified patent and that said Letters Patent is hereby corrected as shown below:

Cover page, column 1, item 75, delete "Durnberg" and substitute therefor --Nurnberg--.

Cover page, column 1, item 73, after "Co.," insert --KG--.

Signed and Sealed this

Seventeenth Day of December, 1991

*Attest:*

HARRY F. MANBECK, JR.

*Attesting Officer*

*Commissioner of Patents and Trademarks*